US011441217B2

(12) United States Patent
Kloewer et al.

(10) Patent No.: US 11,441,217 B2
(45) Date of Patent: Sep. 13, 2022

(54) METHOD FOR PRODUCING SEMI-FINISHED PRODUCTS FROM A NICKEL-BASED ALLOY

(71) Applicant: VDM Metals International GmbH, Werdohl (DE)

(72) Inventors: Jutta Kloewer, Duesseldorf (DE); Ali Aghajani, Bochum (DE); Julia Kraemer geb. Rosenberg, Recklinghausen (DE)

(73) Assignee: VDM Metals International GmbH, Werdohl (DE)

( * ) Notice: Subject to any disclaimer, the term of this patent is extended or adjusted under 35 U.S.C. 154(b) by 219 days.

(21) Appl. No.: 16/761,609

(22) PCT Filed: Dec. 7, 2018

(86) PCT No.: PCT/DE2018/100999
§ 371 (c)(1),
(2) Date: May 5, 2020

(87) PCT Pub. No.: WO2019/114875
PCT Pub. Date: Jun. 20, 2019

(65) Prior Publication Data

US 2020/0325567 A1 Oct. 15, 2020

(30) Foreign Application Priority Data

Dec. 14, 2017 (DE) ..... 10 2017 129 899.1
Dec. 5, 2018 (DE) ..... 10 2018 130 946.5

(51) Int. Cl.
*C22F 1/10* (2006.01)
*C22C 19/05* (2006.01)

(52) U.S. Cl.
CPC ..... *C22F 1/10* (2013.01); *C22C 19/056* (2013.01)

(58) Field of Classification Search
CPC ..... C22C 19/056; C22F 1/10
See application file for complete search history.

(56) References Cited

U.S. PATENT DOCUMENTS

| | | | |
|---|---|---|---|
| 3,660,177 A | 5/1972 | Brown et al. | |
| 6,416,564 B1 | 7/2002 | Bond et al. | |
| 8,394,210 B2 * | 3/2013 | Cao | C22C 19/056 148/428 |
| 10,167,870 B2 | 1/2019 | Eschner | |
| 2016/0071632 A1 | 3/2016 | De Boer et al. | |

FOREIGN PATENT DOCUMENTS

| | | |
|---|---|---|
| DE | 21 24 580 A1 | 12/1971 |
| DE | 602 24 514 T2 | 1/2009 |
| DE | 10 2012 024 130 A1 | 6/2014 |
| DE | 10 2014 008 136 A1 | 12/2014 |
| DE | 10 2015 016 729 A1 | 6/2017 |

OTHER PUBLICATIONS

International Preliminary Report on Patentability in PCT/DE2018/100999, dated Jun. 25, 2020.

International Search Report of PCT/DE2018/100999, dated Feb. 1, 2019.

- N.A. "INCONEL alloy 718" Retrieved from the Internet: www.specialmetals.com/assets/smc/documents/inconel_alloy_718.pdf [retrieved on Jan. 25, 2019] XP055547532, (Sep. 1, 2007), pp. 1-27 (28 pages).

Mckamey C.G. et al. "Creep Properties of Phosphorus+Boron-Modified Alloy 718" Scripta Materia, Elsevier, Amsterdam, NL, vol. 38, No. 3, ISSN: 1359-6462, XP004325045, (Jan. 6, 1998), pp. 485-491.

W.-D. Cao et al. "Effect of Mechanism of Phosphorus and Boron on creep Deformation of Alloy 718", Super Alloys 718, 625, 706 And Various Derivatives : Proceedings of the International Symposium on so Per Alloys 718, 625, 706 And Various Derivatives; Held Jun. 15-18, 1997, ISBN: 978-0-87339-376-8. XP055547633, (Jan. 1, 1997), pp. 511-520.

Kloewer et al., "Effect of Microstructural Particularities on the Corrosion Resistance of Nickel Alloy UNS N07718—What Really Makes the Difference?", NACE International Corrosion Conference & Expo 2017, Paper No. 9068, pp. 1-15.

* cited by examiner

*Primary Examiner* — Jessee R Roe
(74) *Attorney, Agent, or Firm* — Collard & Roe, P.C.

(57) ABSTRACT

A method produces semi-finished products from a nickel-based alloy having the composition (in wt. %): Ni>50-<55%, Cr>17-<21%, Nb>4.8-<5.2%, Mo>2.8-<3.3%, Ti>0.8-<1.15%, Al>0.4-<0.6%, C maximum 0.045%, Co maximum 1.0%, Mn maximum 0.35%, Si maximum 0.35%, S maximum 0.01%, Cu maximum 0.3%, the remainder iron and unavoidable impurities. B 0.0001-0.01%, P 0.0001-0.02% are added. In the method: the alloy is melted, or remelted, to produce preliminary products that then undergo a hot-forming process and subsequently undergo a multi-stage annealing and aging treatment, a solution heat treatment being carried out between 1000 and 1100° C. for 1-3 hours, then cooled in air, water or oil, and made to undergo a precipitation hardening process between 650° C.-<770° C. for 5-9 hours, then cooled to room temperature, the intermediate products undergoing, if necessary, at least one further heating process.

6 Claims, 10 Drawing Sheets

METHOD FOR PRODUCING SEMI-FINISHED PRODUCTS FROM A NICKEL-BASED ALLOY

CROSS REFERENCE TO RELATED APPLICATIONS

Figure 1:
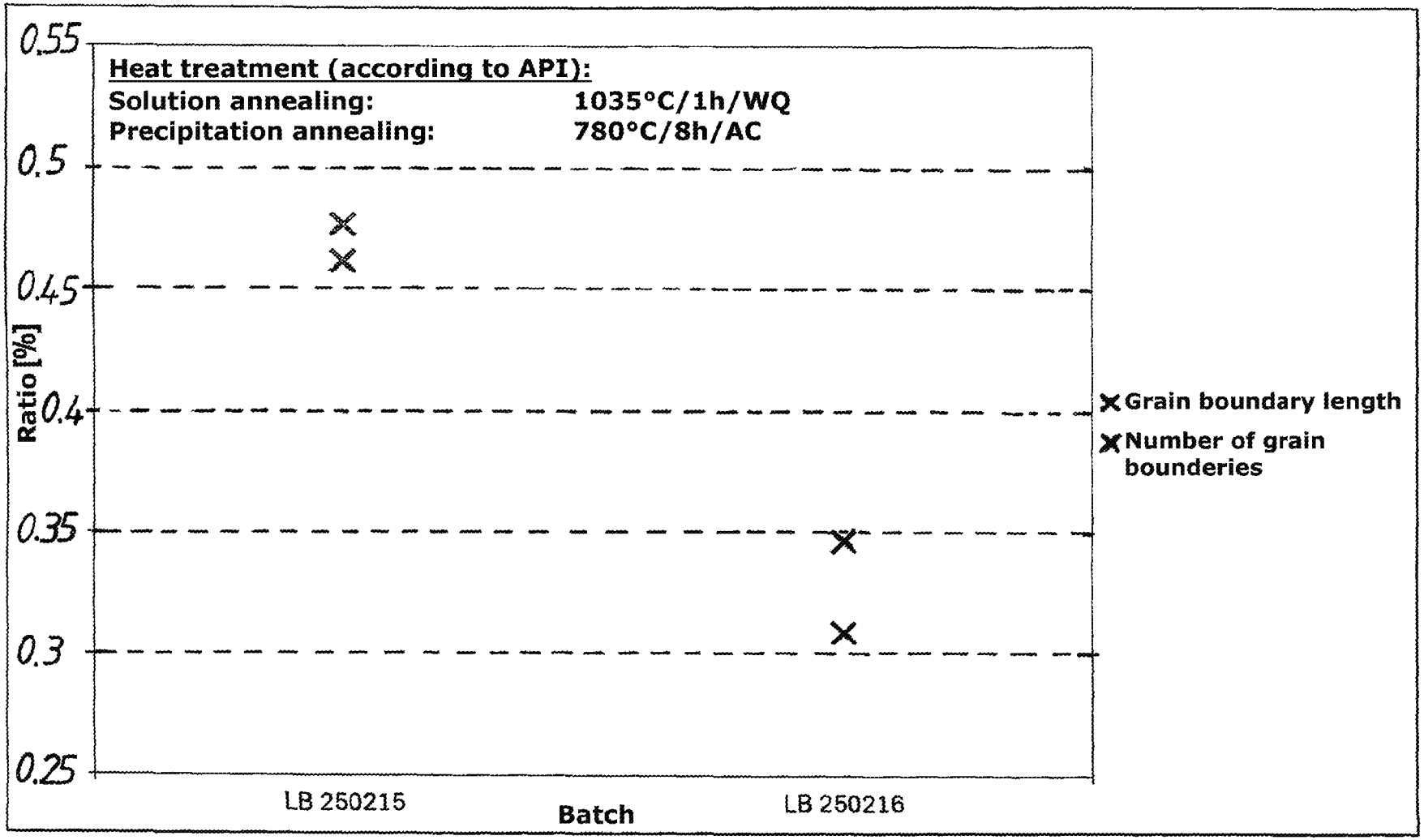

This application is the National Stage of PCT/DE2018/100999 filed on Dec. 7, 2018, which claims priority under 35 U.S.C. § 119 of German Application Nos. 10 2017 129 899.1, filed on Dec. 14, 2017 and 10 2018 130 946.5, filed on Dec. 5, 2018, the disclosures of which are incorporated by reference. The international application under PCT article 21(2) was not published in English.

The invention relates to a method for the manufacture of semifinished products from a nickel-base alloy.

For applications in the oil and gas industry, important criteria are not only corrosion resistance, especially in $H_2S$-containing media, but also the mechanical properties, such as yield strength, notch impact strength and tensile strength.

Materials suitable for use in these areas of application include alloy 718, which has the following general composition (in wt %): Cr 18.5%, C 0.1%, Fe 18%, Ti 0.9%, Al 0.6%, Mo 3%, others 5% (Nb+Ta), the rest Ni and smelting-related impurities.

Increasing requirements imposed on this material necessitate a further development of the base alloy.

DE 21 24 580 discloses a method for improvement of the fatigue resistance of nickel-base alloys, which are capable of being precipitation hardened and which can precipitate intermetallic compounds that are stable above the recrystallization temperature of the alloy. The alloy is thermomechanically processed, in order to form a fine intermetallic acicular precipitate, which simultaneously is distributed through the microstructure of the alloy. Then the alloy is recrystallized in the presence of the acicular phase, in order to obtain a grain size of ASTM 10 or finer. Preferred working conditions, among others for Inconel 718, are the following:

a) Homogenization and precipitation of the eta phase by heat treatment at 899 to 927° C. for a period of 4 to 8 hours,
b) Forging to a reduction of 50 to 65 percent at or below the eta solution temperature of 996° C. or 954° C. respectively, for INCONEL 718,
c) Solution heat treatment with recrystallization at 14 to 18° C. below the eta solution temperature.

The last heat treatment during one hour is intended to be sufficient to achieve recrystallization without substantial grain growth. After the grain size has been established, the alloys are subjected prior to their use to standard aging heat treatments for strain-hardening and precipitation of the hardening γ' phase.

For Inconel 718, this comprises a treatment at 719° C. in the course of 8 hours and at 621° C. in the course of 8 hours.

DE 602 24 514 T2 discloses a method for the manufacture of ingots of nickel-base alloys with large diameter, containing the following process steps:

Casting an alloy, which is a nickel-base superalloy, in a casting mold,

Annealing and overaging the alloy by heating it to at least 649° C. for a duration of at least 10 hours, Electroslag remelting of the alloy at a melting rate of at least 3.63 kg/minute, Transferring the alloy into a heating furnace within 4 hours after complete solidification, Holding the alloy in the heating furnace at a first temperature of 316° C. to 982° C. for a period of at least 10 hours, Raising the furnace temperature from the first temperature to a second temperature of at least 1163° C., such that thermal stresses within the alloy are prevented, Holding at the second temperature for a duration of at least 10 hours, Vacuum arc remelting of a VAR electrode of the alloy at a melting rate of 3.63 to 5 kg/minute in order to manufacture a VAR ingot.

The nickel-base alloy comprises (in wt %):

| | |
|---|---|
| 50.0-55.0% | nickel |
| 17-21.0% | chromium |
| 0-0.8% | carbon |
| 0-0.35% | manganese |
| 0-0.35% | silicon |
| 2.8-3.3% | molybdenum |

niobium and/or tantalum, wherein the total of niobium and tantalum is 4.75 to 5.5%

| | |
|---|---|
| 0.65-1.15% | titanium |
| 0.20-0.8% | aluminum |
| 0-0.006% | boron |

the rest iron and manufacturing-related impurities.

Alloy 718 is one of the most important nickel-base alloys. In the oil and gas industry, the toughness properties and the corrosion resistance are of great importance. Phosphorus is generally classified as a harmful accompanying element.

Beyond this, alloy 718 exhibits susceptibilities to stress-corrosion cracking in hydrogen-containing media. The processes of hydrogen diffusion and of embrittlement as well as subsequent crack formation usually take place at the grain boundaries. If delta phase is present there, hydrogen is able to accumulate there and favor crack formation.

Delta phase is the equilibrium phase of the precipitation-hardening γ" phase ($Ni_3Nb$) and, according to a possibly applicable specification (e.g. API 6A 718), is permitted to be present only in very low contents in the microstructure, since it acts negatively on the mechanical properties.

The task of the invention is to further develop the alloy known as alloy 718 to the effect that, beyond improved resistance to corrosion by acid gas, a higher yield strength as well as a higher tensile strength can be achieved, wherein merely a lower proportion of delta phase is present.

This task is accomplished by a method for the manufacture of semifinished products from a nickel-base alloy of the following composition (in mass %)

Ni >50-<55%
Cr >17-<21%
Nb >4.8-<5.2%
Mo >2.8-<3.3%
Ti >0.8-<1.15%
Al >0.4-<0.6%
C max. 0.045%
Co max. 1.0%
Mn max 0.35%
Si max. 0.35%
S max. 0.01%
Cu max. 0.3%
Fe the rest as well as unavoidable impurities, wherein the following elements are added as alloy constituents within the specified ranges:

B 0.0001-0.01%
P 0.0001-0.02% in that, for production of precursor products, the alloy is melted and if necessary remelted, the precursor products are subjected to at least one hot forming, the precursor products are then subjected to a multi-stage annealing and aging treatment, wherein a solution-annealing treatment is undertaken in the temperature range between 1000 and 1100° C. for a period between 1 hour and 3 hours, the precursor products are cooled in air, water or oil, the precursor products are subjected to a precipitation hardening in the temperature range of 650° C.-<770° C. for a period of 5 hours to 9 hours and the precursor products are cooled to room temperature, wherein the precursor products are subjected if necessary to at least one further heating.

Alternatively, the task is also accomplished by a method for the manufacture of semifinished products from a nickel-base alloy of the following composition (in mass %)

Ni >50-<55%
Cr >17-<21%
Nb >4.8-<5.2%
Mo >2.8-<3.3%
Ti >0.8-<1.15%
Al >0.4-<0.6%
C max. 0.045%
Co max. 1.0%
Mn max 0.35%
Si max. 0.35%
S max. 0.01%
Cu max. 0.3%
Fe the rest as well as unavoidable impurities, wherein the following elements are added as alloy constituents within the specified ranges:

P 0.0001-0.02%
B 0.0001-0.01% in that, for production of precursor products, the alloy is melted and if necessary remelted, the precursor products are subjected to at least one hot forming, the precursor products are then subjected to a multi-stage annealing and aging treatment, wherein a solution-annealing treatment is undertaken in the temperature range between 1000 and 1100° C. for a period between 1 hour and 3 hours, the precursor products are cooled in air, water or oil, the precursor products are subjected to a two-stage precipitation hardening, namely in the temperature range of 650° C.-<770° C. at first for a period of 5 hours to 9 hours and then in the temperature range of 600° C.-650° C. for a period of 5 hours to 9 hours and the precursor products are cooled to room temperature, wherein the precursor products are subjected if necessary to at least one further heating.

Advantageous further developments of the alternative methods can be inferred from the associated dependent claims.

By defined addition of boron and/or phosphorus as alloying elements, it was possible to bring about an improvement of approximately 15% in the resistance to acid gas. By addition of boron and/or phosphorus as alloying elements in conjunction with the cited heat-treatment parameters, it is possible to obtain a microstructure with very low proportion of delta phase and thus an improvement of the corrosion properties.

Optimized boron and phosphorus contents lead beyond this to improvement of the properties at the grain boundaries and prevent the precipitation of delta phase.

The boron content may be located between 30 and 60 ppm.

The phosphorus content lies between 70 and 130 ppm.

The following advantages are achieved compared with the prior art:

Phosphorus increases the resistance to acid gas.
Phosphorus makes the grain size finer.
Phosphorus has no negative influence on mechanical properties.
Boron leads to better toughness properties and improved notch impact energy.
The influence of boron on corrosion is positive.

Due to the different heat treatments, it is possible to obtain different material properties.

The yield strength and tensile strength respectively may be increased by variation of the precipitation-hardening temperature.

No negative influence on the resistance to acid gas is developed.

In the method according to the invention, specimens of the precursor product are subjected to a corrosion test with low strain rate, wherein a reduction of area at break $Z \geq 0.57$ is obtained during the use of an NaCl solution with additions of $CO_2$ and $H_2S$.

Preferably, the reduction of area at break of the specimens exposed to a 24% NaCl solution with additions of $CO_2$ and $H_2S$ is brought about at 149° C. and a strain rate of $4 \times 10^6$.

Beyond this, the notched-bar impact bend tests performed on the alloy yield a notch impact energy of ≥215 J.

In comparison with the method according to the invention, the alloy considered here may be used preferably for the following applications:

$H_2S$-containing media
Acid-gas conditions
Oil and gas industry
Natural-gas processing plants
Natural-gas production The method according to the invention will be explained in more detail on the basis of the following examples:

In the following, it will be examined how higher contents of phosphorus and boron act on the mechanical properties as well as the corrosion properties of the alloy known as alloy 718. In the process, the requirements of the specification API 6A 718 applicable to the material during use in the oil and gas industry will be complied with.

Table 1 shows the chemical composition of the laboratory batches LB 250215 (alloy 718) and 250216 (alloy 718P):

TABLE 1

| Alloy | Batch | Ni [wt %]* | Cr [wt %] | Fe [wt %] | Nb [wt %] | Mo [wt %] | Ti [wt %] | Al [wt %] | Si [wt %] | P [ppm] | B [ppm] |
|---|---|---|---|---|---|---|---|---|---|---|---|
| 718 | 250215 | 54.63 | 18.73 | 16.60 | 5.28 | 3.05 | 1.04 | 0.60 | 0.035 | 0 | 0 |
| 718P | 250216 | 54.51 | 18.80 | 16.55 | 5.34 | 3.08 | 1.05 | 0.60 | 0.030 | 100 | 0 |

The laboratory batches indicated in Table 1 were rolled to a thickness of 12 mm. The poor-quality regions (shrinkage cavities, pores) that could not be used for further investigations were identified by ultrasonic inspection.

For each batch, respectively six notched-bar impact specimens with the dimensions of 10 mm×10 mm×55 mm were made with an ISO V-notch. The specimens were taken along the rolling direction. Respectively three of the specimens were previously heat-treated at 1050° C. for 2.5 hours and the second set of respectively three specimens was annealed at 1025° C. for 1 hour. The notched-bar impact tests were performed in accordance with ASTM E23 at room temperature. Then the fracture faces as well as ground sections made from the specimens were examined under the scanning electron microscope (SEM).

For each batch, respectively one tensile specimen of the form B 6×30 (diameter 6 mm, initial gauge length 30 mm, thread diameter 10 mm=M10) according to DIN 50125 was fabricated. The preceding heat treatment consisted of solution annealing at 1035° C. for 1 hour with subsequent quenching in water and precipitation annealing at 774° C. for 8 hours and cooling in air. The tension tests were performed in accordance with ASTM E8 at room temperature.

Heat Treatment

The following heat treatments were carried out on specimens (approximately 20×20×12 mm) in the mechanical laboratory (Table 2):

TABLE 2

| | | Heat treatment 1 | | | Heat treatment 2 | | |
|---|---|---|---|---|---|---|---|
| Batch | Alloy | Temperature [° C.] | Time [h] | Cooling | Temperature [° C.] | Time [h] | Cooling |
| LB 250215 and LB 250216 | 718 and 718P | 1090 | 1 | Water | — | — | — |
| | | 1090 | 1 | Water | 740 | 2 | Air |
| | | 1090 | 1 | Water | 740 | 4 | Air |
| | | 1090 | 1 | Water | 740 | 8 | Air |
| | | 1090 | 1 | Water | 760 | 2 | Air |
| | | 1090 | 1 | Water | 760 | 4 | Air |
| | | 1090 | 1 | Water | 760 | 8 | Air |
| | | 1090 | 1 | Water | 780 | 2 | Air |
| | | 1090 | 1 | Water | 780 | 4 | Air |
| | | 1090 | 1 | Water | 780 | 8 | Air |
| | | 1090 | 1 | Water | 820 | 8 | Air |
| | | 870 | 8 | Water | — | — | — |
| | | 870 | 8 | Water | 1020 | 1 | Water |
| | | 870 | 8 | Water | 1035 | 1 | Water |
| | | 870 | 8 | Water | 1050 | 1 | Water |
| | | 870 | 8 | Water | 1050 | 2 | Water |

Hardness/Grain Size/SEM

Hardness measurements according to Rockwell C were made on all specimens having the heat treatments described in the foregoing. Respectively 3 measuring indentations were made on each specimen. The solution-annealed specimens were tested for hardness according to Brinell.

The grain size was measured on all specimens.

All specimens were examined under the scanning electron microscope for the presence and the content of delta phase. The specimens were embedded, ground, polished and etched in Kalling's no. 2. This solution permits a selective etching, in which the delta phase "stands out" from the microstructure. Images at various magnifications were recorded with the electron microscope in the backscattered electron mode.

Corrosion Test

Respectively one cut-to-size portion from the sheets was heat-treated as follows: solution annealing at 1035° C. for 1 hour and quenching in water and precipitation annealing at 780° C. for 8 hours and cooling in air. The cut-to-size portions were subjected to corrosion tests with low strain rate ("Slow Strain Rate Test"-SSRT). In the process, round tensile specimens (specimen length 25.4 mm, diameter: 3.88 mm) were exposed to a corrosive medium consisting of 24% NaCl solution with addition of CO2 (5.52 MPa) and H2S (2.76 MPa) and loaded to break at 149° C. with a strain rate of 4.0×10 6. The time to break and the reduction of area at break were measured. Respectively three tests were carried out in the corrosive medium, as were two tests under inert condition (in air). As the test result, the lifetime and the reduction of area at break were indicated as the ratio of the values, i.e. as Z(med)/Z(inert), for example.

SEM

Cut-to-size portions of specimens from sheets of the laboratory batches were heat-treated. From each specimen, one ground section respectively was prepared along the rolling direction by standard metallographic methods: embedding, grinding, polishing. The specimens were examined in the non-etched condition under the scanning electron microscope. From each specimen, several images were recorded in the backscattered-electron mode. Due to the higher niobium content of the delta phase and the relatively high atomic mass in comparison with nickel and the other alloying elements, delta phase appears as a bright phase in the backscattered-electron image. The bright-dark contrasts of the images were optically evaluated by an algorithm in order to determine the content and morphology of delta phase in the microstructure. The number of grain boundaries occupied by delta phase was estimated by counting or determining the length of grain boundaries in several representative images. In the process, a distinction was made between grain boundaries and apparent twinning grain boundaries or between occupied and free grain boundaries.

The following tables show the results of diverse tests. Table 3 shows the notched-bar impact bend tests performed on the laboratory batches.

TABLE 3

| | | Solution annealing | | | Notch | | |
|---|---|---|---|---|---|---|---|
| Specimen | Alloy | Temperature [° C.] | Duration [h] | Cooling | impact energy [J] | Mean value [J] | Standard deviation [J] |
| A-1 | 718_1 | 1050 | 2.5 | Water | 235.1 | 235.0 | 6.00 |
| A-2 | | | | | 240.9 | | |
| A-3 | | | | | 228.9 | | |
| B-1 | 718_1 | 1025 | 1 | Water | 218.0 | 220.8 | 2.66 |
| B-2 | | | | | 221.0 | | |
| B-3 | | | | | 223.3 | | |
| C-1 | 718P_1 | 1050 | 2.5 | Water | 215.8 | 222.7 | 6.36 |
| C-2 | | | | | 224.1 | | |
| C-3 | | | | | 228.3 | | |
| D-1 | 718P_1 | 1025 | 1 | Water | 223.9 | 224.6 | 5.13 |
| D-2 | | | | | 219.8 | | |
| D-3 | | | | | 230.0 | | |

Table 4 shows the tension tests undertaken on the laboratory batches:

TABLE 4

| Batch | Alloy | Phosphorus content [ppm] | Rp0.2 [MPa] | Rp0.2 [ksi] | Rm [MPa] | Rm [ksi] | A5 [%] | Z [%] |
|---|---|---|---|---|---|---|---|---|
| LB 25021 | 718_1 | 0 | 994.8 | 144.3 | 1275.4 | 185.0 | 28.9 | 47.1 |
| LB 250216 | 718P_1 | 100 | 966.9 | 140.2 | 1268.8 | 184.0 | 32.0 | 41.7 |

Table 5 reflects the hardness of the laboratory batches:

TABLE 5

| Batch | Heat treatment HT 1 | Heat treatment HT 2 | Hardness (HRC) 1 | Hardness (HRC) 2 | Hardness (HRC) 3 | Hardness (Brinell) 1 | Hardness (Brinell) 2 | Hardness (Brinell) 3 |
|---|---|---|---|---|---|---|---|---|
| LB 250215 | 1090° C./1 h/WQ | — | | | | 85 | 85 | 85 |
| | 1090° C./1 h/WQ | 740° C./2 h/AC | 34 | 34 | 34 | | | |
| | 1090° C./1 h/WQ | 740° C./4 h/AC | 38 | 39 | 39 | | | |
| | 1090° C./1 h/WQ | 740° C./8 h/AC | 39 | 39 | 40 | | | |
| | 1090° C./1 h/WQ | 760° C./2 h/AC | 33 | 32 | 34 | | | |
| | 1090° C./1 h/WQ | 760° C./4 h/AC | 39 | 38 | 38 | | | |
| | 1090° C./1 h/WQ | 760° C./8 h/AC | 41 | 40 | 41 | | | |
| | 1090° C./1 h/WQ | 780° C./2 h/AC | 36 | 38 | 37 | | | |
| | 1090° C./1 h/WQ | 780° C./4 h/AC | 37 | 39 | 38 | | | |
| | 1090° C./1 h/WQ | 780° C./8 h/AC | 39 | 38 | 38 | | | |
| | 870° C./8 h/WQ | — | | | | | | |
| | 870° C./8 h/WQ | 1020° C./1 h/WQ | | | | | | |
| | 870° C./8 h/WQ | 1035° C./1 h/WQ | | | | | | |
| | 870° C./8 h/WQ | 1050° C./1 h/WQ | | | | | | |
| | 870° C./8 h/WQ | 1050° C./2 h/WQ | | | | | | |
| | 1090° C./1 h/WQ | 820° C./8 h/AC | | | | | | |
| LB 250216 | 1090° C./1 h/WQ | — | | | | 87 | 88 | 87 |
| | 1090° C./1 h/WQ | 740° C./2 h/AC | 35 | 36 | 35 | | | |
| | 1090° C./1 h/WQ | 740° C./4 h/AC | 38 | 39 | 39 | | | |
| | 1090° C./1 h/WQ | 740° C./8 h/AC | 41 | 41 | 40 | | | |
| | 1090° C./1 h/WQ | 760° C./2 h/AC | 38 | 39 | 38 | | | |
| | 1090° C./1 h/WQ | 760° C./4 h/AC | 39 | 40 | 40 | | | |
| | 1090° C./1 h/WQ | 760° C./8 h/AC | 41 | 41 | 41 | | | |
| | 1090° C./1 h/WQ | 780° C./2 h/AC | 38 | 38 | 38 | | | |
| | 1090° C./1 h/WQ | 780° C./4 h/AC | 39 | 40 | 39 | | | |
| | 1090° C./1 h/WQ | 780° C./8 h/AC | 39 | 40 | 40 | | | |
| | 870° C./8 h/WQ | — | | | | | | |
| | 870° C./8 h/WQ | 1020° C./1 h/WQ | | | | | | |
| | 870° C./8 h/WQ | 1035° C./1 h/WQ | | | | | | |
| | 870° C./8 h/WQ | 1050° C./1 h/WQ | | | | | | |
| | 870° C./8 h/WQ | 1050° C./2 h/WQ | | | | | | |
| | 1090° C./1 h/WQ | 820° C./8 h/AC | | | | | | |

Data of the corrosion investigations performed are presented in Table 6

TABLE 6

| Batch | Heat treatment: Solution on annealing | Heat treatment: Precipitation annealing | P content [ppm] | EL [%] | TF [h] | Lifetime t (med)/ t (inert) | Mean value t (med)/ t (inert) | RA [%] | Reduction of area at break Z (med)/ Z (inert) | Mean value Z (med)/ Z (inert) | Secondary cracks? Gauge length/ shoulders | Main crack completely ductile? |
|---|---|---|---|---|---|---|---|---|---|---|---|---|
| LB 250215 | 1035° C./1 h/WQ | 780° C./8 h/AC | 0 | 24.2 | 16.8 | | | 46.4 | | | | |
| | | | 0 | 23.8 | 16.5 | | | 49.2 | | | | |
| | 1035° C./1 h/WQ | 780° C./8 h/AC | 0 | 17.3 | 12.0 | 0.72 | 0.72 | 27.3 | 0.57 | 0.57 | No/No | No |
| | | | 0 | 1.7 | 1.2 | 0.07 | | 12.6 | 0.26 | | No/No | No |
| | | | 0 | 1.4 | 1.0 | 0.06 | | 11.4 | 0.24 | | No/No | No |
| LB 250216 | 1035° C./1 h/WQ | 780° C./8 h/AC | 100 | 23.2 | 16.1 | | | 41.5 | | | | |
| | | | 100 | 22.8 | 15.8 | | | 40.0 | | | | |
| | 1035° C./1 h/WQ | 780° C./8 h/AC | 100 | 18.9 | 13.1 | 0.82 | 0.83 | 28.4 | 0.70 | 0.73 | Yes/No | No |
| | | | 100 | 19.4 | 3.5 | 0.84 | | 31.1 | 0.76 | | No/No | No |
| | | | 100 | 9.2 | 6.4 | 0.40 | | 21.6 | 0.53 | | No/No | No |

In the following table, four further laboratory batches having different B+P contents are indicated.

TABLE 7

| | Batch 250264 | Batch 250265 | Batch 250266 | Batch 250267 |
|---|---|---|---|---|
| C | 0.021% | 0.020% | 0.018% | 0.021% |
| S | 0.0039% | 0.0032% | 0.0030% | 0.0018% |
| N | 0.0040% | 0.0070% | 0.0040% | 0.0080% |
| Cr | 18.69% | 18.64% | 18.59% | 18.55% |

TABLE 7-continued

| | Batch 250264 | Batch 250265 | Batch 250266 | Batch 250267 |
|---|---|---|---|---|
| Ni | 54.71% (the rest) | 54.619% (the rest) | 54.617% (the rest) | 54.694% (the rest) |
| Mn | 0.01% | 0.01% | 0.01% | 0.010% |
| Si | 0.04% | 0.06% | 0.04% | 0.030% |
| Mo | 2.98% | 3.00% | 2.99% | 3.00% |
| Ti | 0.98% | 0.99% | 1.00% | 1.00% |
| Nb | 4.99% | 5.00% | 4.98% | 5.04% |
| Cu | 0.010% | 0.010% | 0.010% | 0.010% |

TABLE 7-continued

| | Batch 250264 | Batch 250265 | Batch 250266 | Batch 250267 |
|---|---|---|---|---|
| Fe | 16.95% | 17.04% | 17.05% | 16.97% |
| P | 0.0030% | 0.0030% | 0.011% | 0.016% |
| Al | 0.530% | 0.520% | 0.60% | 0.57% |
| Mg | 0.0080% | 0.011% | 0.013% | 0.010% |
| B | 0.0010% | 0.0030% | 0.0010% | 0.0040% |

Conclusions

In order to identify delta phase in the microstructure indisputably, images with high resolution in the scanning electron microscope are needed. The brightness of the phases in the backscattered-electron mode is dependent on the atomic mass of the elements. On the basis of the high proportion of niobium in the delta phase ($Ni_3Nb$) in comparison with the matrix and of the relatively high atomic mass of niobium in comparison with the other main alloying elements, delta phase appears very brightly and therefore can be identified relatively easily. In contrast, under the light microscope, the grain boundaries appear at first sight to be free of delta phase. It is only in SEM that the phases at the grain boundaries are visible. Thus light microscopy has only limited ability to measure the content of delta phase in the microstructure.

The evaluation of the SEM images revealed that the ratio of occupied grain boundaries to the total number of grain boundaries decreases with increasing batch number, regardless of whether the length or the number of grain boundaries is considered (see FIG. 1).

The maximum length of the delta particles is on average approximately 0.14 μm in batch 250215 and 0.08 μm in batch 250216. The averaged size of the delta particles also decreases slightly with increasing batch number, from 0.06 μm to 0.055 μm. On the whole, it can be stated that less delta phase is present in the specimen from batch 250216 than in that from batch 250215.

Figure 2:
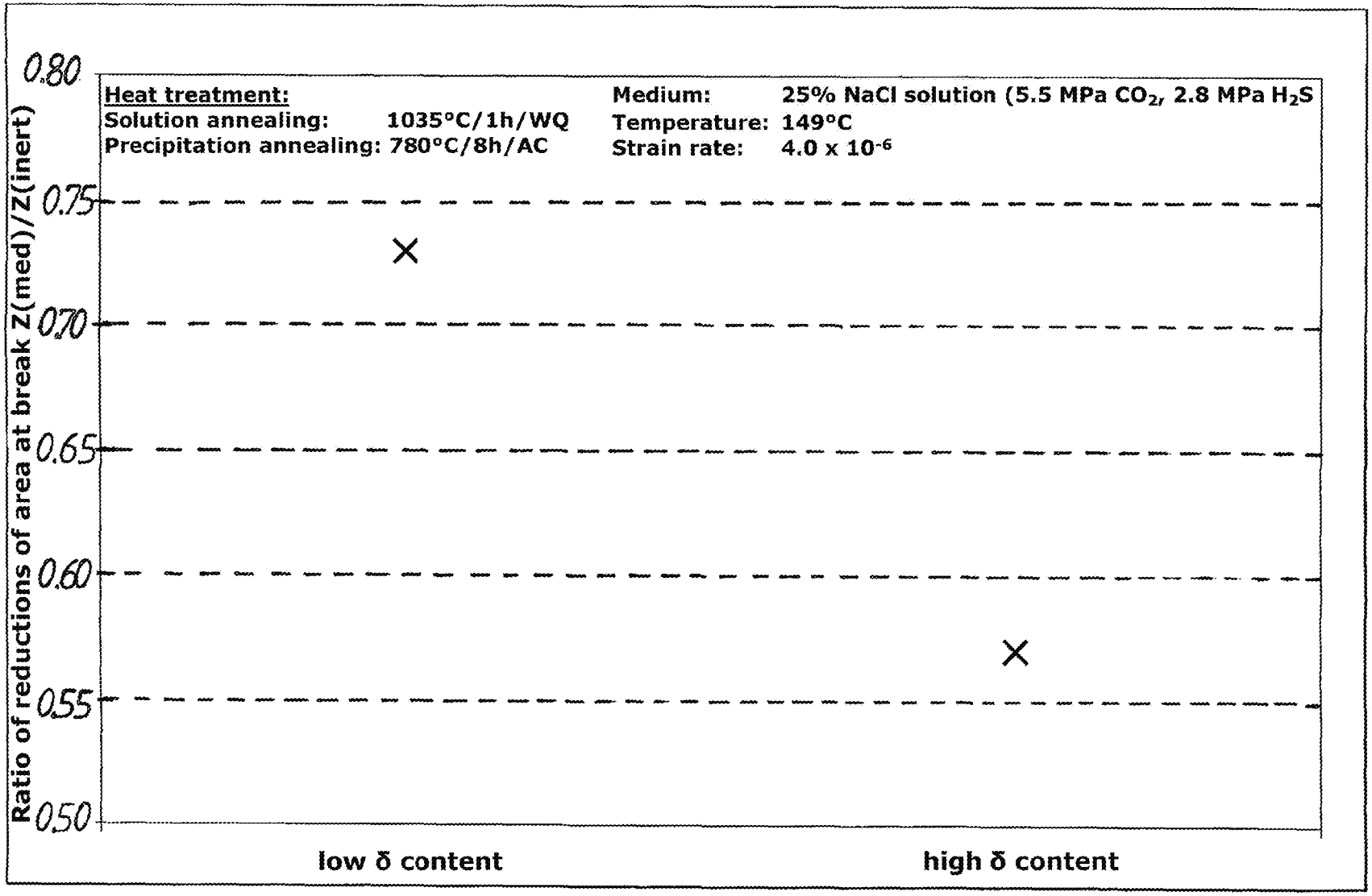

If the results of the SSRT test are now compared, it is found that the specimen from batch 250216 having the lower content of delta phase at the grain boundaries reaches higher values in the reduction of area at break as well as in the lifetime. As examples, the values for the reduction of area at break are illustrated here (see FIG. 2).

It confirms the suspicion that delta phase at the grain boundaries acts adversely on the corrosion properties, especially on stress-corrosion cracking in hydrogen-containing media.

Influence of the Heat Treatment: Solution Annealing

In order to investigate the influence of temperature during solution annealing on the content of delta phase, specimens were first annealed at 870° C. for 8 hours, in order to produce a microstructure with the highest possible proportion of delta phase. Then solution annealing was carried out at temperatures between 1020° C. and 1090° C. for respectively 1 hour, and the specimens were examined under the electron microscope for the presence of delta phase.

In the initial condition after sensitization annealing, clearly massive delta phase precipitates are visible at the grain boundaries and growing into the grain. At 1020° C., a considerable fraction of the delta phase has already passed into solution and, at 1050° C., delta phase is now almost hardly perceptible at the grain boundaries. The subsequent investigations in the SEM with better resolution show that delta phase can still be identified in material solution-annealed at 1050° C. At 1090° C., it can be assumed that delta phase has passed completely into solution.

Influence of the Chemical Composition: Boron

Figure 3:
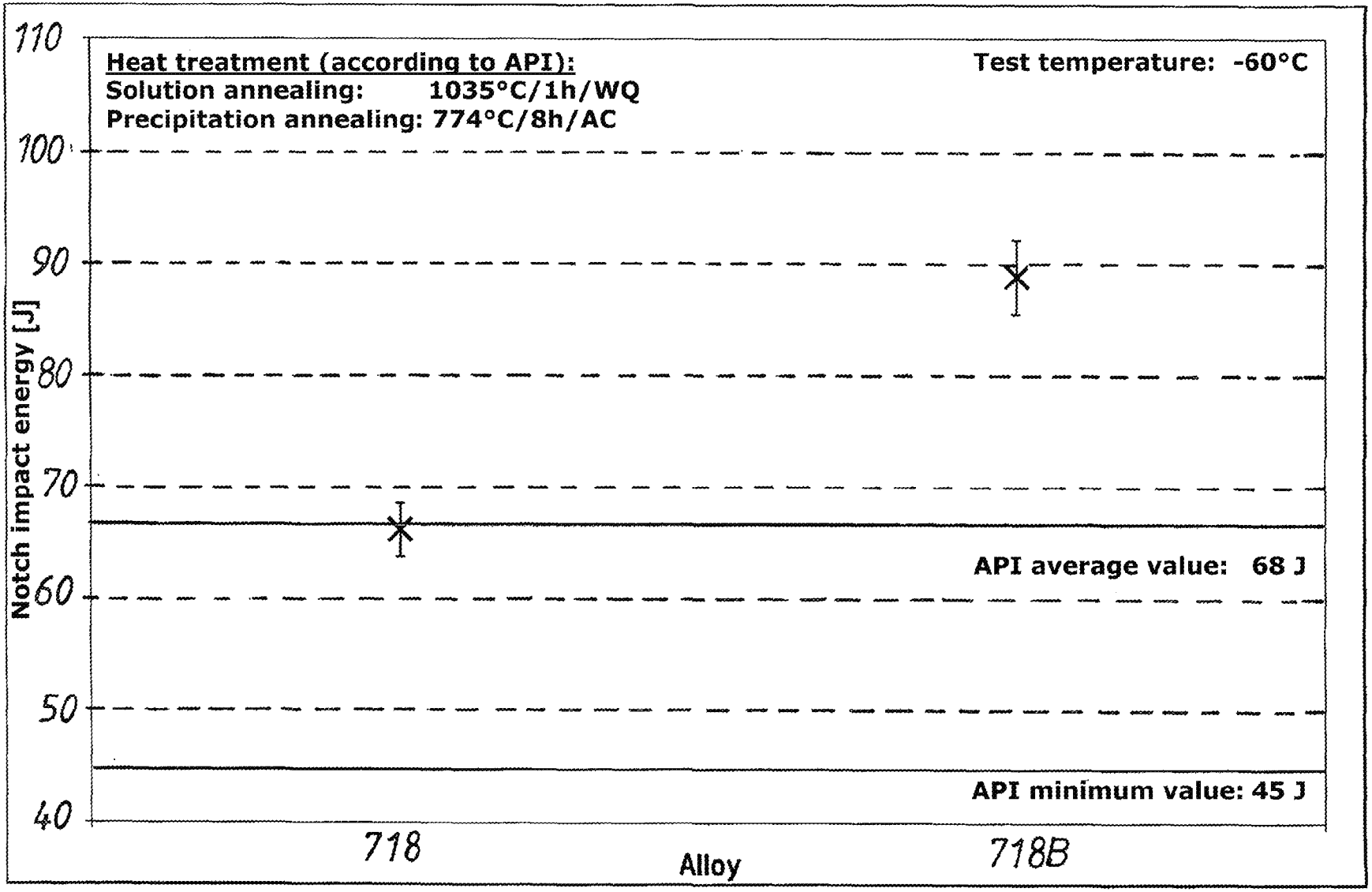
Figure 4:
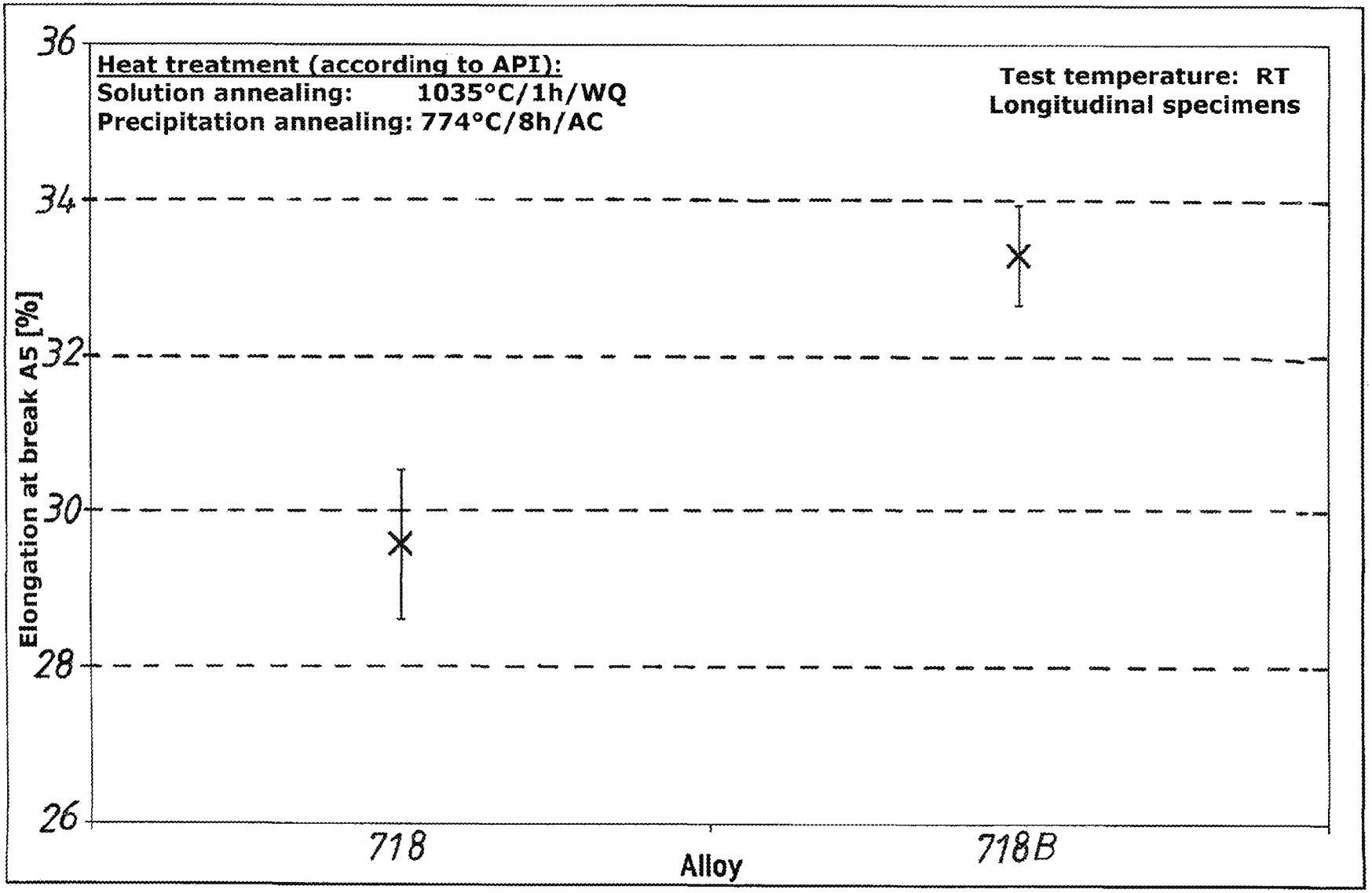

On the basis of the higher values for the notch impact energy (FIG. 3) and the elongation at break (FIG. 4) in the tension test of the batch having high boron content, it is assumed that the addition of boron favorably influences the ductility or toughness of the alloy.

Figure 5:
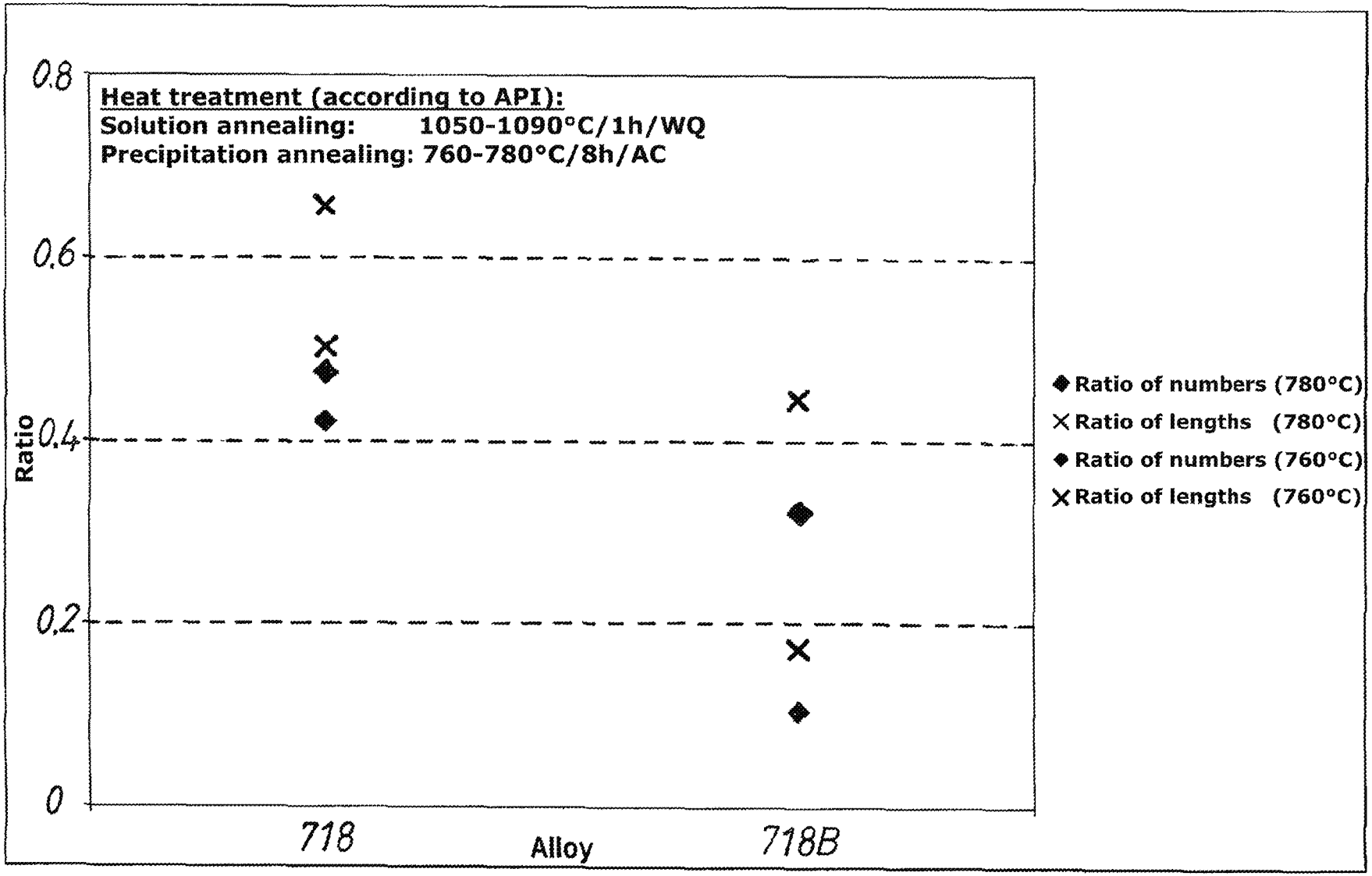

In addition, the results of the SEM investigation permit the conclusion that an elevated boron content is correlated with a lower percentage of delta phase in the microstructure. In FIG. 5, it may be clearly recognized that the relative number and length of occupied grain boundaries decreases with higher boron content. The maximum particle length decreases by as much as 0.07 μm. Since boron preferably segregates at the grain boundaries and since the precipitation of delta phase at the selected temperatures also takes place at the grain boundary, this effect could be attributed to the fact that the nucleation during the precipitation is delayed by the boron atoms, which are present in the free volume of the grain boundary. Moreover, it can be assumed that the boron atoms delay the diffusion of niobium—needed for precipitation—to the grain boundary.

On the basis of the results, it is expected that the boron-containing batches will show better corrosion properties in the SSRT tests, which are still in progress. This would also be reinforced by the stated suppositions about the relationship between the content of delta phase in the microstructure and the susceptibility to hydrogen-induced stress corrosion cracking.

Influence of the Chemical Composition: Phosphorus

Figure 6:
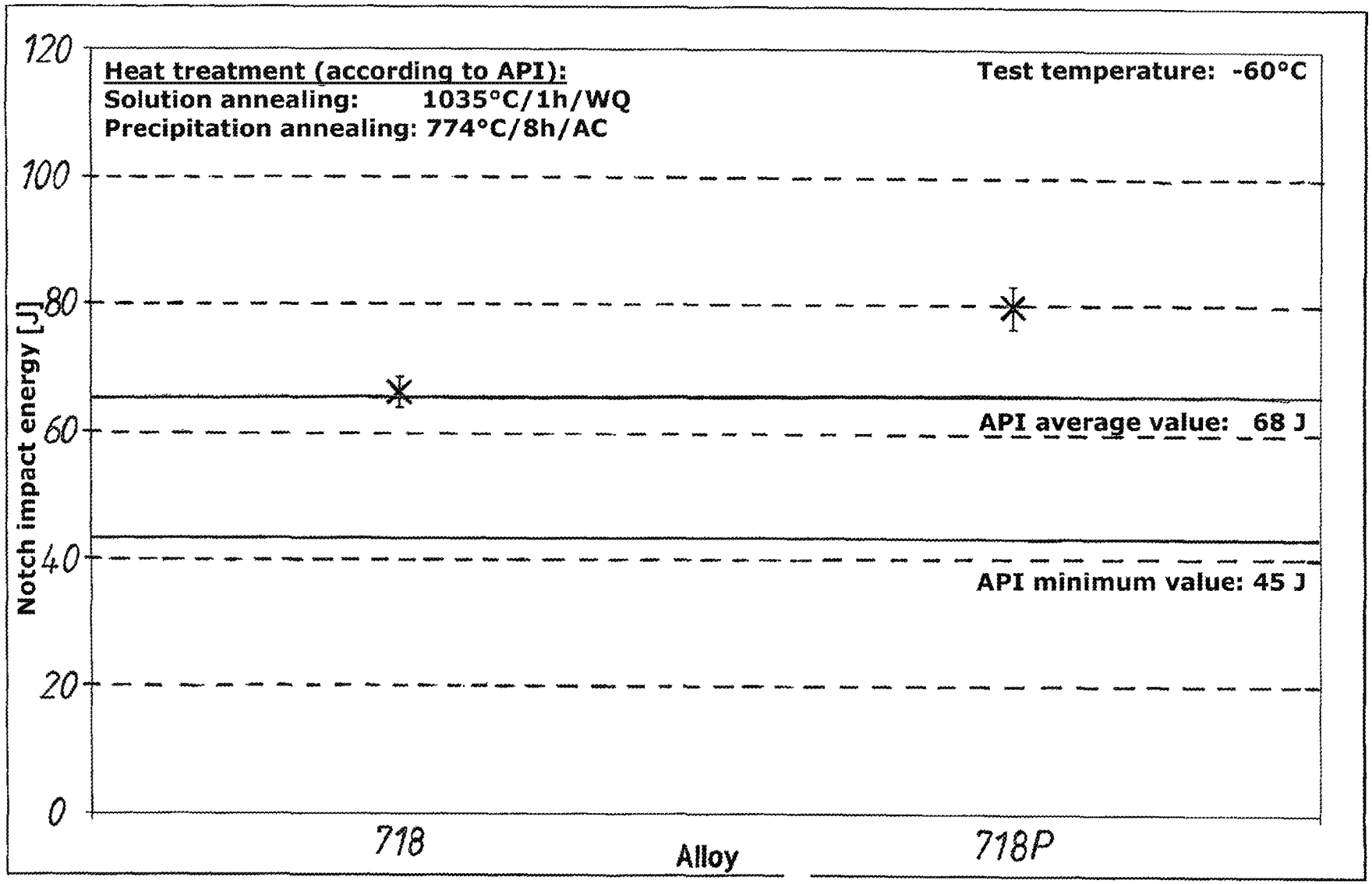
Figure 7:
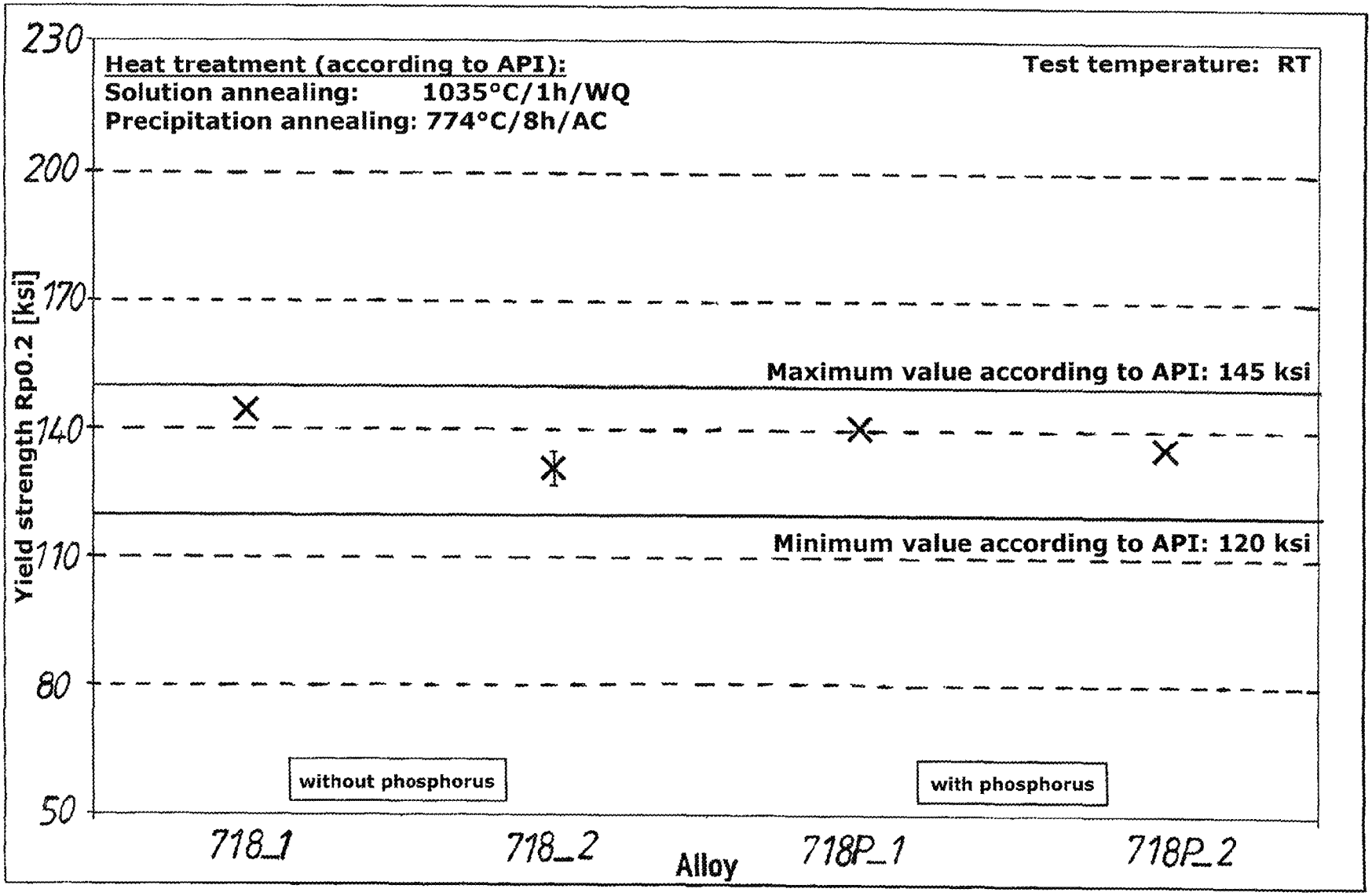

On the basis of the values measured in the notched-bar impact bend test and in the tension test, it can be stated that the addition of phosphorus does not entail any disadvantages for the mechanical properties of the material. The notch impact energy (FIG. 6), yield strength (FIG. 7) and elongation at break show almost constant values regardless of the phosphorus content, and they do so in both parent batches.

Figure 8:
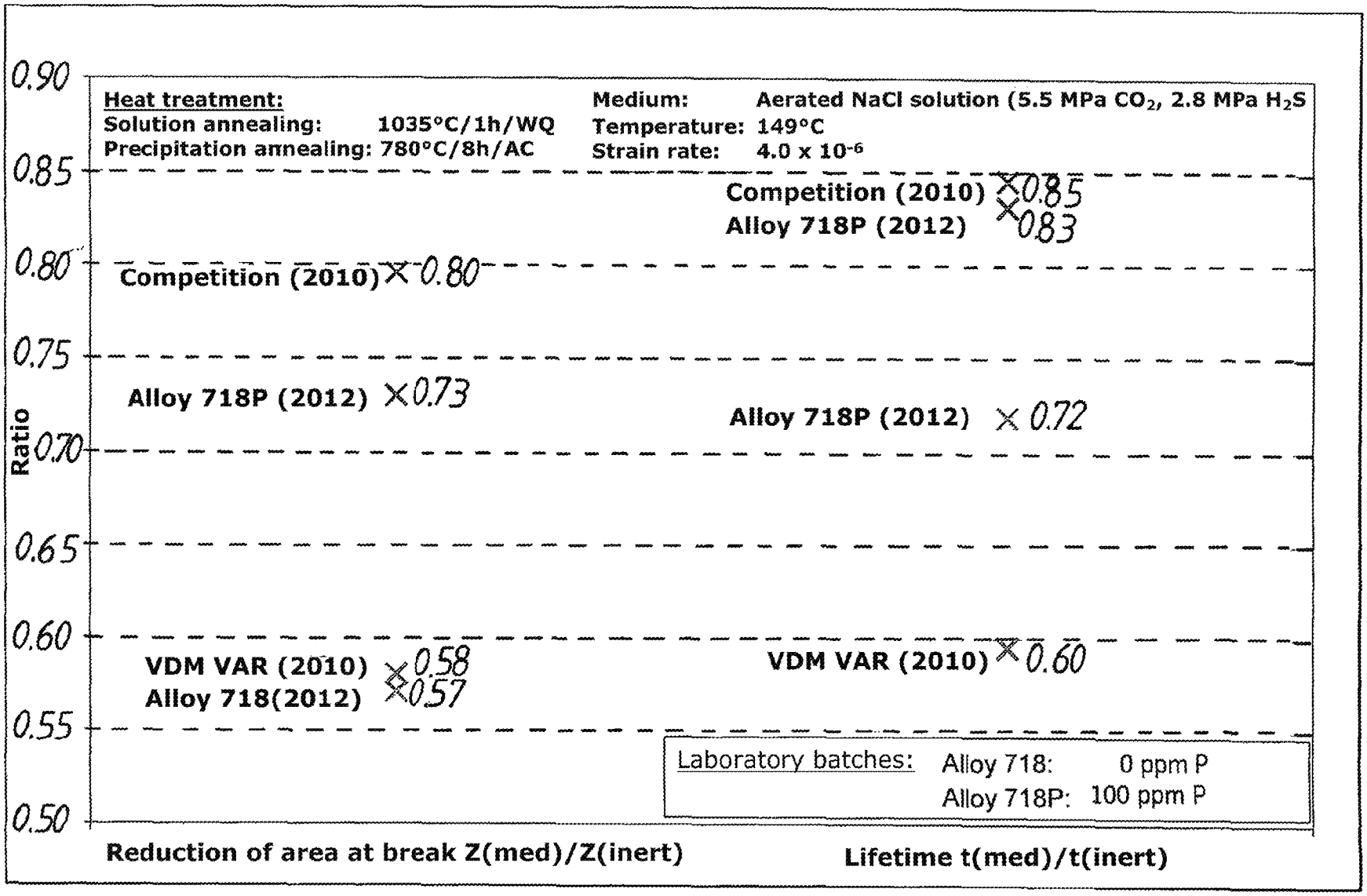

In the SSRT corrosion test, the material with phosphorus addition shows clearly higher values for the reduction of area at break as well as the lifetime. In FIG. 8, moreover, values from a test with VAR material are shown for comparison. It is to be pointed out that the batches prepared on the laboratory scale, which normally exhibit a higher level of impurities, perform better as regards lifetime than does comparable material from the VAR process. The specimen alloyed with phosphorus has a slightly lower value of reduction of area at break and almost the same value of lifetime.

Just as for boron, the phosphorus-containing specimens also exhibit a lower percentage of grain boundaries occupied by delta phase. Here also, a delayed nucleation or diffusion could play a role.

Figure 9:
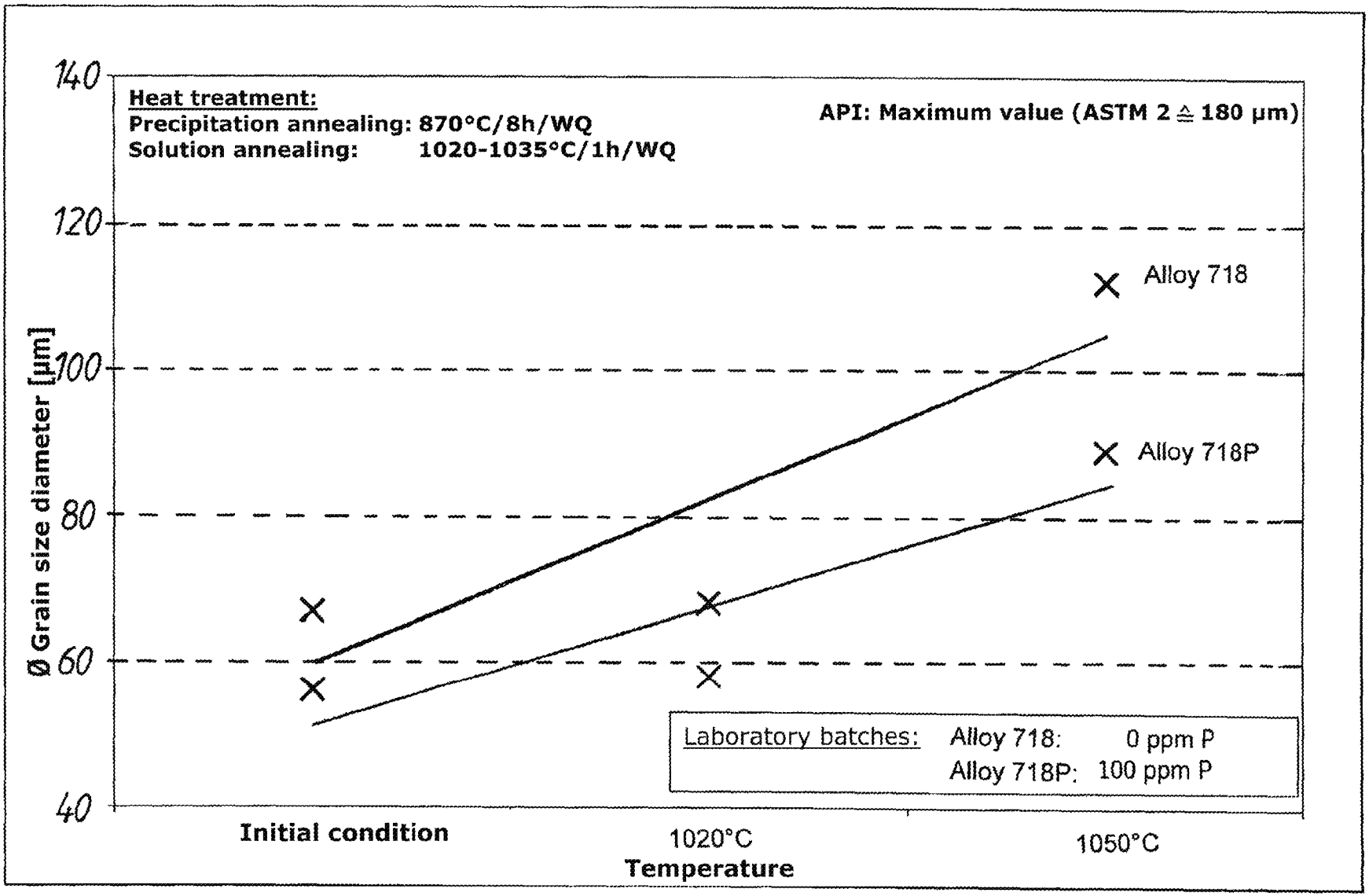
Figure 10:
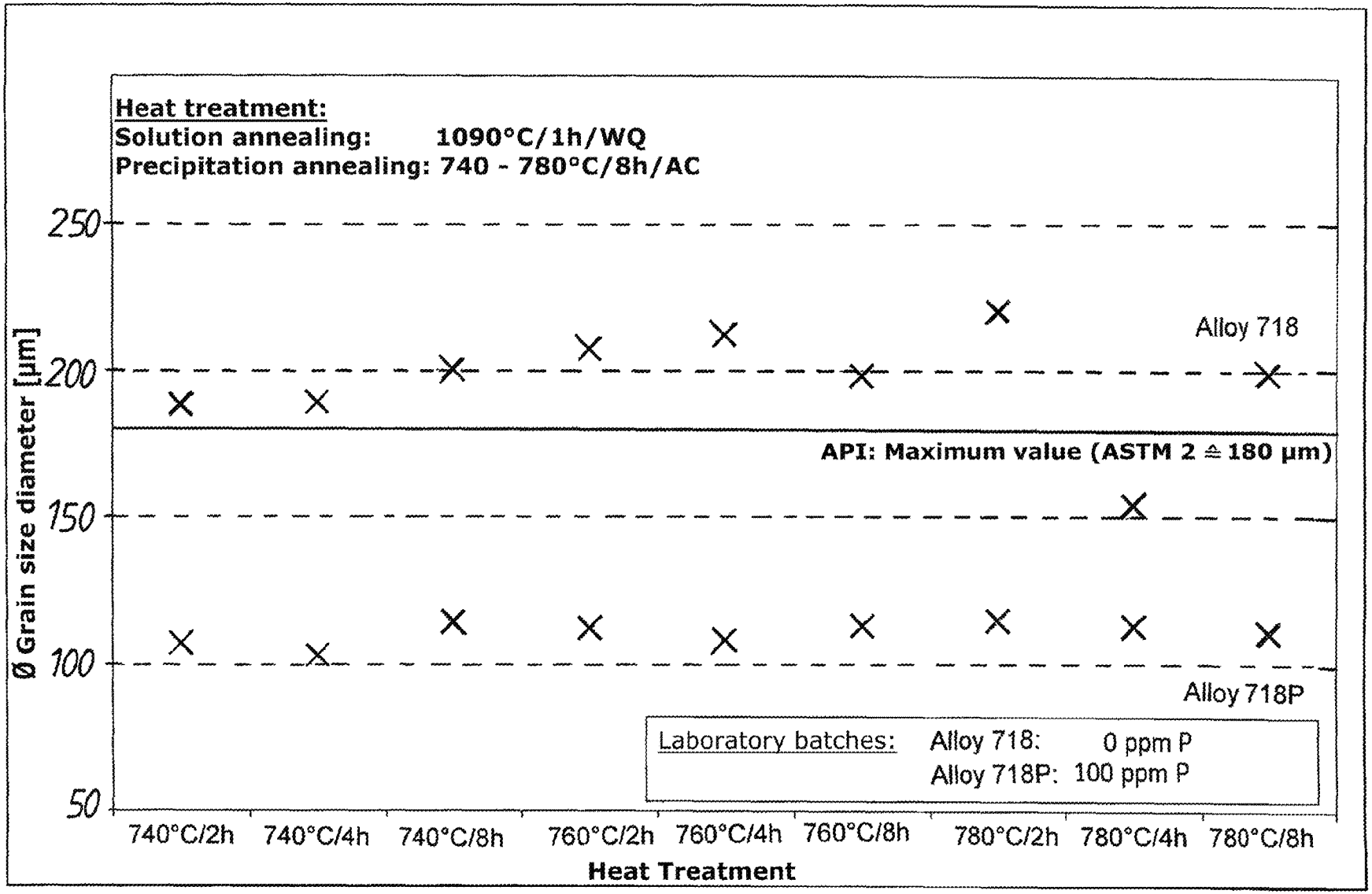

In the investigation of the specimens by the metallography, it is apparent that almost all phosphorus-containing specimens have a smaller mean grain size than does the comparison material. This effect is found for the solution-annealed specimens (FIG. 9) as well as for the precipitation-annealed specimens (FIG. 10). For the precipitation-annealed specimens, the preceding solution-annealing at 1090° C. is to be pointed out. At this temperature, delta phase passes completely into solution. Therefore the effect of grain refinement is actually to be attributed to the phosphorus content and not to any delta phase that may be present in the microstructure. Even the maximum grain size was consistently smaller in the phosphorus-containing specimens than in the comparison material. Phosphorus could have an advantageous effect on the formation of duplex microstructure. In a series of tests with specimens that were annealed at temperatures similar to those in forging, it was to be investigated whether this effect may also be used to advantage. At temperatures of 1080° C. to 1140° C., however, the grain-refining effect of phosphorus could no longer be observed.

In summary, it can be stated that an addition of boron and phosphorus as alloying elements leads to an improvement of or to constant mechanical properties. If the concentration of the alloying elements at the grain boundaries is too high, however, this acts unfavorably on the tensile strength and the hardness. Starting from the phosphorus and boron contents in the investigated laboratory batches, an addition of 40 ppm boron and 80 ppm phosphorus as alloying elements is recommended. The results described above suggest that an optimum combination of mechanical properties and corrosion resistance may be achieved in this way.

The invention claimed is:

1. A method for the manufacture of semifinished products from a nickel-base alloy of the following composition (in mass %)

Ni >50-<55%
Cr >17-<21%
Nb >4.8-<5.2%
Mo >2.8-<3.3%
Ti >0.8 to <1.15%
Al >0.4 to <0.6%
C max. 0.045%
Co max. 1.0%
Mn max. 0.35%
Si max. 0.35%
S max. 0.01%
Cu max. 0.3%
Fe the rest as well as unavoidable impurities, wherein the following elements are added as alloy constituents within the specified ranges:

B 0.0001-0.01%
P 0.0001-0.02% wherein, for production of precursor products, the alloy is melted and if necessary remelted, the precursor products are subjected to at least one hot forming, the precursor products are then subjected to a multi-stage annealing and aging treatment, wherein a solution-annealing treatment is undertaken in the temperature range between 1000 and 1100° C. for a period between 1 hour and 3 hours, the precursor products are cooled in air, water or oil, the precursor products are subjected to a precipitation hardening in the temperature range of 650° C.-<770° C. for a period of 5 hours to 9 hours and the precursor products are cooled to room temperature, wherein the precursor products are subjected if necessary to at least one further heating, and wherein specimens of the precursor product are subjected to a corrosion test with low strain rate, wherein a reduction of area at break ratio Z≥0.57 is obtained during the use of an NaCl solution with additions of $CO_2$ and $H_2S$.

2. The method according to claim 1, wherein the limit values for B and P are given as follows:

B 30-60 ppm
P 70-130 ppm.

3. The method according to claim 1, comprising the total formula P+B

P+B≤150 ppm.

4. The method according to claim 1, wherein the reduction of area at break of the specimens exposed to a 24% NaCl solution with additions of $CO_2$ and $H_2S$ is brought about at 149° C. and a strain rate of $4\times10^{-6}$.

5. The method according to claim 1, wherein the notched-bar impact bend tests performed on the alloy yield a notch impact energy of ≥215 J.

6. A method for the manufacture of semifinished products from a nickel-base alloy of the following composition (in mass %)

Ni >50-<55%
Cr >17-<21%
Nb >4.8-<5.2%
Mo >2.8-<3.3%
Ti >0.8 to <1.15%
Al >0.4 to <0.6%
C max. 0.045%
Co max. 1.0%
Mn max. 0.35%
Si max. 0.35%
S max. 0.01%
Cu max. 0.3%
Fe the rest as well as unavoidable impurities, wherein the following elements are added as alloy constituents within the specified ranges:

B 0.0001-0.01%
P 0.0001-0.02% wherein, for production of precursor products, the alloy is melted and if necessary remelted, the precursor products are subjected to at least one hot forming, the precursor products are then subjected to a multi-stage annealing and aging treatment, wherein a solution-annealing treatment is undertaken in the temperature range between 1000 and 1100° C. for a period between 1 hour and 3 hours, the precursor products are cooled in air, water or oil, the precursor products are subjected to a two-stage precipitation hardening, namely in the temperature range of 650° C.-<770° C. at first for a period of 5 hours to 9 hours and then in the temperature range of 600° C.-650° C. for a period of 5 hours to 9 hours and the precursor products are cooled to room temperature, wherein the precursor products are subjected if necessary to at least one further heating, and wherein specimens of the precursor product are subjected to a corrosion test with low strain rate, wherein a reduction of area at break ratio Z≥0.57 is obtained during the use of an NaCl solution with additions of $CO_2$ and $H_2S$.

* * * * *